US005839432A

United States Patent [19]

Daneshvar

[11] Patent Number: 5,839,432

[45] Date of Patent: Nov. 24, 1998

[54] FACE-COVERING HOOD WITH INNER LINER AND VENT SPACE

[76] Inventor: Yousef Daneshvar, 21459 WoodFarm, Northville, Mich. 48167

[21] Appl. No.: 340,659

[22] Filed: Nov. 16, 1994

Related U.S. Application Data

[63] Continuation-in-part of Ser. No. 261,172, Jun. 13, 1994, abandoned, and a continuation-in-part of Ser. No. 179,329, Jan. 10, 1994.

[51] Int. Cl.[6] ..... A62B 7/10; A62B 19/00; A62B 23/02; A42B 1/04

[52] U.S. Cl. ..... 128/201.25; 128/201.23; 128/201.19; 128/201.24; 2/205; 2/416

[58] Field of Search ..... 128/201.12, 201.14, 128/201.15, 201.19, 201.22–201.25, 201.28, 201.17, 201.29, 206.21, 206.24, 206.26–206.28, 207.11; 2/410, 15, 10, 6.3–6.5, 422–425, 427–429, 4, 5, 7, 8, 9, 414, 202, 205, 416

[56] References Cited

U.S. PATENT DOCUMENTS

| | | | |
|---|---|---|---|
| H1039 | 4/1992 | Tripp, Jr. et al. | 128/201.23 |
| 302,048 | 7/1884 | Stockley | 2/410 |
| 312,471 | 2/1885 | Holden | 2/4 |
| 354,658 | 12/1886 | Runge et al. | 128/201.23 |
| 405,850 | 6/1889 | Rollins | 128/201.25 |
| 551,491 | 3/1895 | Jennings | 2/4 |
| 618,001 | 1/1899 | Beach | 2/4 |
| 1,041,610 | 10/1912 | Fabian | 2/5 |
| 1,154,494 | 9/1915 | Edelhausen | 2/5 |
| 1,164,351 | 12/1915 | Hulstrom | 2/4 |
| 1,176,901 | 3/1916 | Jessup | 128/201.23 |
| 1,184,785 | 5/1916 | Stern | 128/201.23 |
| 1,244,559 | 10/1917 | Stocks | 2/416 |
| 1,583,872 | 6/1926 | Davis | 2/4 |
| 2,280,668 | 4/1942 | Sherlock | 2/4 |
| 2,314,889 | 3/1943 | Manson et al. | 128/201.23 |
| 2,410,593 | 11/1946 | Wright | 128/201.23 |
| 2,414,405 | 1/1947 | Bierman et al. | 128/201.19 |
| 2,541,242 | 2/1951 | Grove | 2/13 |
| 2,642,574 | 6/1953 | Eloranta | 128/201.28 |
| 2,860,632 | 11/1958 | Conti | 128/201.23 |
| 3,055,012 | 9/1962 | Aileo | 2/410 |
| 3,098,233 | 7/1963 | Hoagland | 2/424 |
| 3,100,896 | 8/1963 | Khanbegian | 2/5 |
| 3,258,010 | 6/1966 | Austin et al. | 2/416 |
| 3,298,031 | 1/1967 | Morgan | 128/201.24 |
| 3,433,222 | 3/1969 | Pinto | 128/201.24 |
| 3,528,415 | 9/1970 | Malmin | 128/201.12 |
| 4,091,469 | 5/1978 | Davidson | 2/410 |
| 4,141,086 | 2/1979 | Jackson | 2/436 |
| 4,172,455 | 10/1979 | Beaussant | 128/201.23 |
| 4,180,868 | 1/1980 | Snow | 2/205 |
| 4,227,520 | 10/1980 | Lord | 128/201.24 |
| 4,296,746 | 10/1981 | Mason, Jr. et al. | 128/201.12 |
| 4,336,799 | 6/1982 | Almasi et al. | 128/201.24 |

(List continued on next page.)

FOREIGN PATENT DOCUMENTS

| | | | |
|---|---|---|---|
| 359192 | 5/1938 | Italy | 2/416 |

*Primary Examiner*—Kimberly L. Asher

[57] ABSTRACT

Cold weather, especially when combined with wind and moisture, can cause significant health problems. In practice it will limit productivity and a normal human's activity. The bad effects will be even worse in people who have cardio-respiratory problems. Therefore, this applicant introduces a unit that will prevent such exposure and its related problems. These hats will be made from combinations of an outer and an inner cover. The inner cover is a soft lining and the outer cover is a protective cover that will stand over the first cover. The outer layer will be non-permeable and will not allow air or moisture to move in. This unit will be further fortified by a brim, shield, filter and means that will allow the motion of the air inside the nose-mouth area to be controlled. The unit may also have a tubing to allow oxygen or another treated gas to come in. These units may also have other pieces such as microphones and speakers in order to allow communication to be facilitated in difficult circumstances. The applicant believes these units will bring significant comfort to mankind.

14 Claims, 6 Drawing Sheets

U.S. PATENT DOCUMENTS

| | | | |
|---|---|---|---|
| 4,411,023 | 10/1983 | Pinson | 2/7 |
| 4,462,399 | 7/1984 | Braun | 128/201.24 |
| 4,589,408 | 5/1986 | Singer | 128/201.25 |
| 4,593,417 | 6/1986 | Brown, Jr. et al. | 2/209.1 |
| 4,602,385 | 7/1986 | Warren | 2/410 |
| 4,610,247 | 9/1986 | Stroup | 128/201.28 |
| 4,667,667 | 5/1987 | Schnoor et al. | 128/201.24 |
| 4,768,235 | 9/1988 | Webster | 2/205 |
| 4,817,596 | 4/1989 | Gallet | 128/201.24 |
| 4,972,527 | 11/1990 | Wallace | 2/410 |
| 4,987,609 | 1/1991 | Zahn | 2/416 |
| 5,016,625 | 5/1991 | Hsu et al. | 128/201.24 |
| 5,062,163 | 11/1991 | Avey | 2/424 |
| 5,109,549 | 5/1992 | Mattinson | 2/7 |
| 5,251,336 | 10/1993 | Nevins | 2/202 |

FACE-COVERING HOOD WITH INNER LINER AND VENT SPACE

This application is a CIP of U.S. Ser. No. 08/261,172 filed on Jun. 13, 1994, now abandoned; and a CIP of U.S. Ser. No. 08/179,329, filed on Jan. 10, 1994, still pending.

REFERENCES TO RELATED APPLICATIONS

Please notice that since some of the ideas of this invention were previously introduced to the Patent office by this applicant, he therefore wishes to ask that this application be a continuation in part of his previous pending applications of Super Masks and Fun Caps. The contents of the following applications are incorporated by reference as if they were fully disclosed herein. The application for Super Masks was filed on Jan. 10, 1994, with the Ser. No: 08/179,329 and the application for Fun Caps was filed Jun. 13, 1994, with Ser. No: 08/261,172.

BACKGROUND OF THIS INVENTION

Cold weather causes a significant problem in human activity and, especially when combined with wind, causes even worse effects. This combination is one of the well known causes of angina pectoris (chest discomfort from the heart) in cases in which the person has coronary artery disease. It also causes problems in patients who suffer from lung disease or sinus problems. The worst circumstances occur with a cold, moist and wind combination. This causes almost everyone to suffer. The effect of these conditions is mostly seen in the uncovered face. For these reasons the inventor introduces new hats which, in his belief, are more suitable for modern life.

BRIEF EXPLANATION OF THE INVENTION

These hats will be made from combinations of two covers: one soft lining inside and one protective cover to stand on the top of the first one. The outer layer will be non-permeable and will not allow air or moisture to come in. This unit will be further fortified with a brim, shield, filter and means that will allow the motion of the air inside the nose-mouth area to be controlled. The unit may also have other pieces such as microphones and speakers in order to allow communication in difficult circumstances to be facilitated.

BRIEF EXPLANATION OF THE FIGURES

Please notice that in order to prevent crowded pictures the applicant has shown important parts of this unit in different figures. This is due to the artistic limits of the applicant only.

DETAILED EXPLANATIONS OF THE FIGURES

Figure 1:
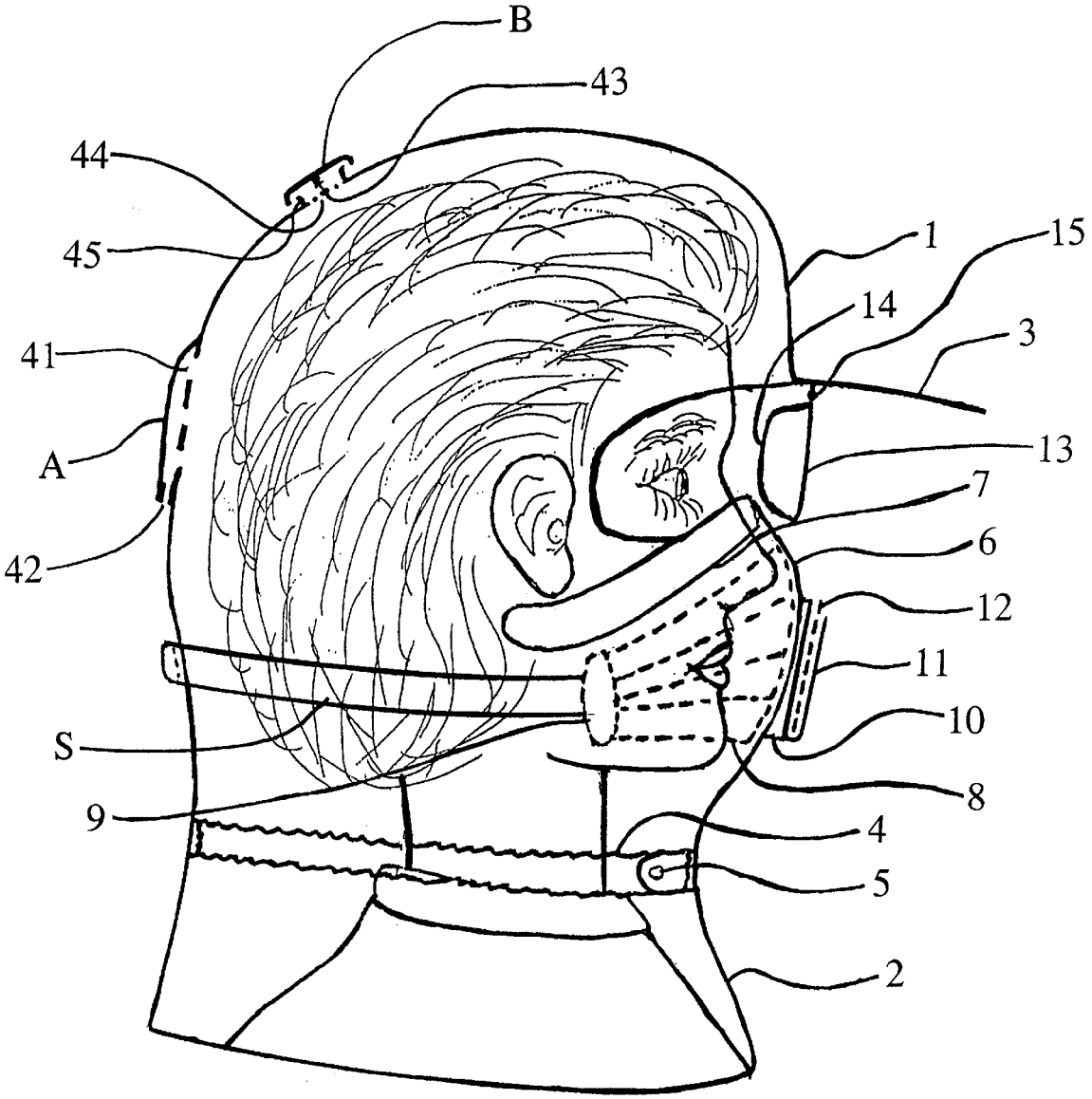
FIG. 1 shows the side view of a person who is wearing a super hat.

FIG. 1. This figure schematically shows the side view of a person who is wearing the outer layer of a super hat. In this figure the body of the unit is shown at 1 and will be made from a layer of plastic, fabric, their combinations or mostly from a non-permeable flexible layer. This unit will have a lower part shown at 2 which will go over the shoulders in order to prevent air or moisture from coming inside. The connection area of these two parts may be made with an elastic ribbon 4 that can be adjusted by piece 5 to allow the area to be more comfortable. This unit has a front piece 6 which will be comfortably held away from the nose and mouth by the structure or skeleton shown at 8. This skeleton has the means and capacity to prevent the layer of the unit from standing against the mouth and nose, thus preventing a sense of suffocation. The area between the nose and mouth is separated from the eye area by an adjustable band 7 in order to prevent fogging of the eye piece. This piece may be made from sponge, pads, balloons and some metal wires or bands which allow them to hold the given shape. The mouth area will be connected to one or more exhaust systems (marked at 9) which may be placed in a proper area such as the sides of the face in order to allow the exhaled air to be expelled without going to other areas and causing fog or moisture. The exhaust system may have an adjustable opening which is not shown here. It may also have a flap, cover or door in order to control air motion through the exhaust. This flap consists of two pieces of round plastic with openings. These pieces will be connected to each other by a pole in their center so that the outer plastic can be rotated in order to allow the openings to match each other or to oppose each other. This will allow the amount of incoming air to be controlled. The edge of the outer plastic may be curved to cover the inner unit in order to prevent snow from entering.

Figure 6:
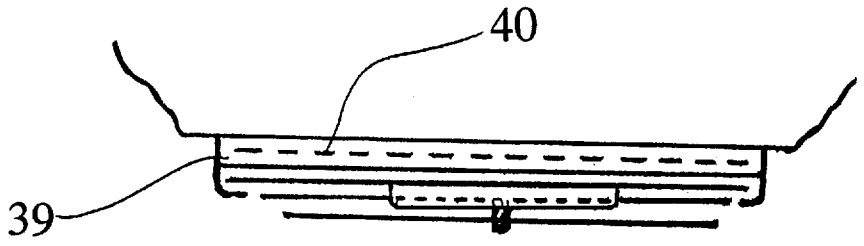
FIG. 6 shows the cross-cut view of a unit which also has an extra slot for a filter.
Figure 7:
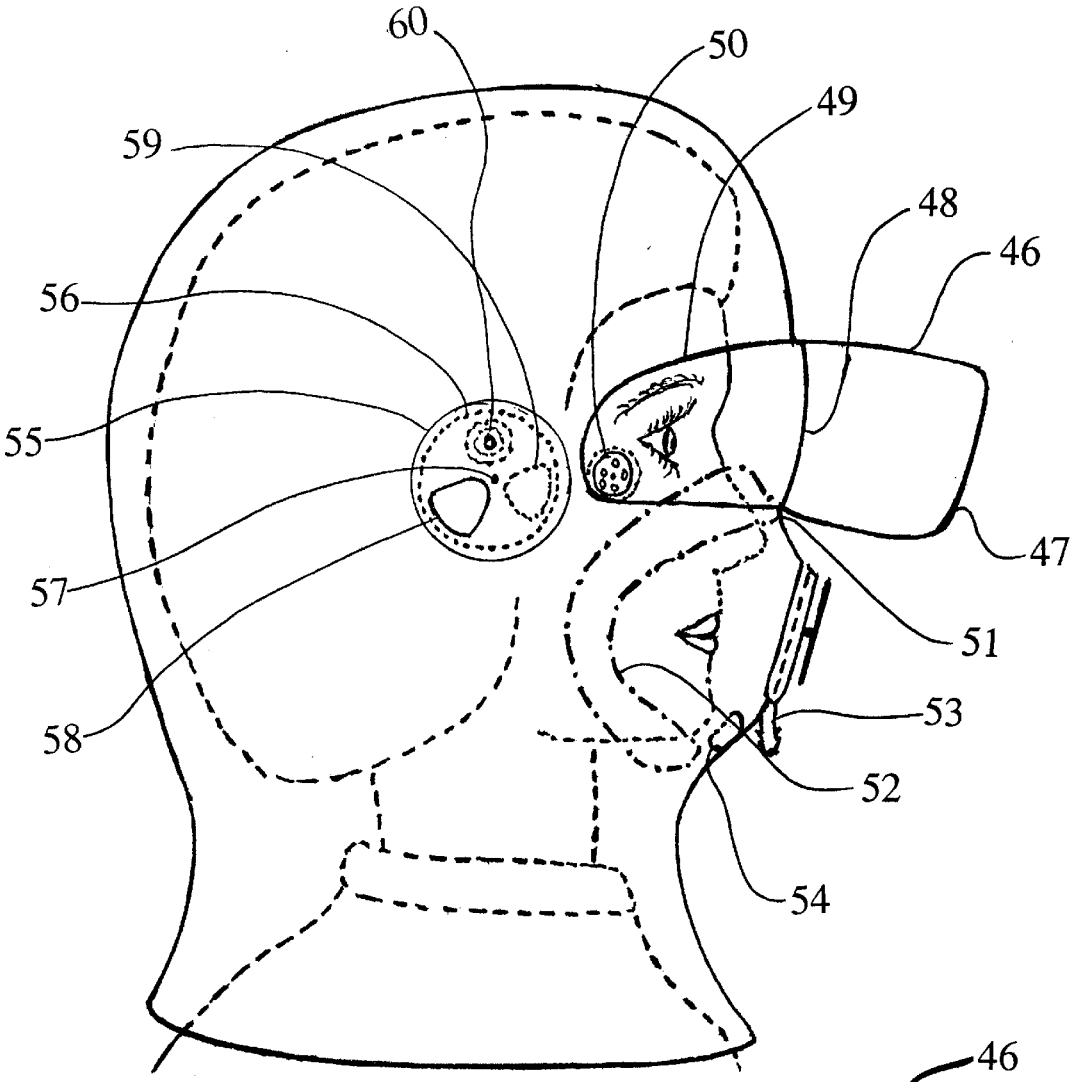
FIG. 7 shows some of the options and important points of these units.

A sample of this unit is shown for the ear at FIG. 7. This unit may also have a means to allow air motion into the area to be controlled. This will consist of a piece 10 that is attached to the body of the unit in the mouth area and has a slot whose border is marked at 11. This will allow a matching piece 12 which has a controllable air window that is to be inserted into it. The detail of this unit will be discussed in FIG. 3 and 4. Piece 12 will have adjustable openings in front of the mouth and nose which will allow the amount of the air which comes into the nose and mouth area to be controlled. This will give an advantage in conditions such as cold and windy days. This unit will also allow a filter to be placed in this area so that the air can be affected by that filter (this is shown in more detail in FIG. 6). Such a filter will be placed inside a slot in front of the nose/mouth area. Importantly, the nature of this filter may vary depending on the environment of the area in which it is used. Importantly, the mechanism for units 10–12 will allow different kinds of pieces to be inserted into this slot and to be used for different purposes. This unit will also allow a cover to be hinged to the body of the unit so that it will allow the unit to be opened and closed easily in order to allow the mouth and nose area to be accessed easily for cleaning, drinking, eating, communication, etc. This will be easily done by having a frame in the base of this unit and by attaching the unit 10–12 by a hinge. A snap will allow it to be kept in the closed position.

Figure 8:
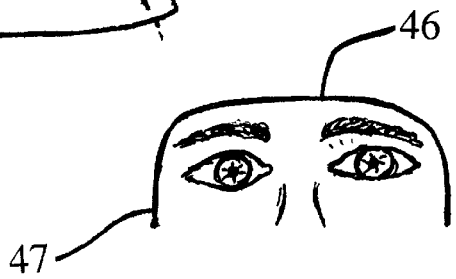
FIG. 8 shows a portion of the front view of the unit shown in the previous FIG. 7.
Figure 10:
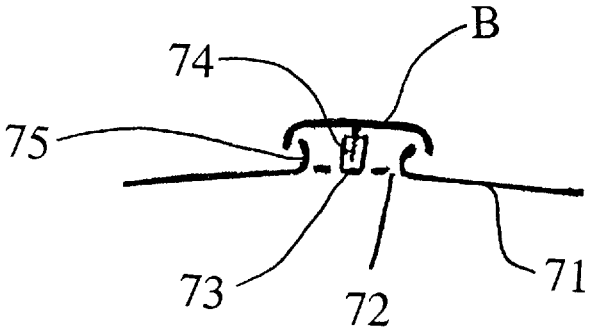
FIG. 10 is a cross section view of a ventilation device on a headcover.

The unit will also have a brim 3 which will protect the person from sun, snow and rain. This brim may be made clear; however, it may have a matching colored piece which will be attached to it in order to make it non-opaque. Importantly, in some models the sides of the brim will extend to the sides to act like clear walls and prevent air from entering from the sides. A model of this unit is shown in FIGS. 7 & 8. This will be beneficial in preventing wind, rain and snow from blowing into the vision area and causing problems. Also, this brim will have a clear shield 13 which will be hinged to a piece 3 at 15. Shield 13 may also be made to be a fixed part of the body of the brim so that it will all be one piece. Importantly, the units that allow the shield to be rotated upward will allow eye glasses to be used with them easily, although the other units will also be adjusted to allow glasses to be used with them as well. This shield will have wings on the sides (one is shown at 14) which will prevent the wind or cold air from disturbing the person from the sides. Also, they will prevent the edges of shield 13 from moving towards the eye and causing problems. Importantly, the lower border of the shield may be connected to the body of the unit in order to prevent air from moving inside. The sides of this piece may have openings to allow the steaming of the eye area (due to sweat or evaporation of tears) to dissipate. These openings may have covers to allow them to be closed. The size of the shield and its shape may vary from model to model. Even in cases in which the shield will be tilted downward, the lower rim of the shield and the body of the cover may be designed to functionally close the area and prevent air from moving in. This will depend on each model. Importantly, the lower edge of the shield may be made from a softer plastic to go over the cover of the main unit and prevent air from moving inside. The shield may be made to slide into the area as well. The main unit may also have a band similar to the one shown at 7 in order to go around the mouth area or in the lower part, close to neck, in order to prevent moist air from moving into unwanted areas. The ear covering may also have a window to allow it to be opened. This window may be directional in order to allow noise to be gathered from a particular site. This unit may also have openings in its body in order to allow ventilation under the unit to occur in order to allow extra heat and sweat to escape. These openings may have covers in order to close them when needed. One such opening is shown at A. In this simple model the fenestrated area 41 is covered by cover A which will be closed by means 42. This cover may be opened and kept open by having it attach to the outer surface of the unit. Another model of such a ventilation unit is shown at B. In this model the fenestrated area 44 has a screw 43 in its center which is holding the piece B on its end. The piece B may be made to rotate along the screw 43 in order to close the opening or can be rotated in the other direction to open the ventilation area. The sides 45 of this opening will be curved outside to prevent water from entering the unit. The details of such a unit are shown at FIG. 10. Many of the above-mentioned methods may be used in order to make such a ventilation opening. Importantly, the brim and the related shield may be made detachable, which may be done by many simple means. In one such model, the body of the outer cover will have a short brim in front which will accept another separate matching brim. This brim may also have a shield connected to its body. This unit can be attached to the short brim by different means such as snapping, screwing, sliding, etc. The outer cover will also have a band or strap in order to pull the front pieces toward the back and hold the front pieces in place securely. In this Fig. this is shown at S and is an adjustable band that will go around the unit.

Figure 2:
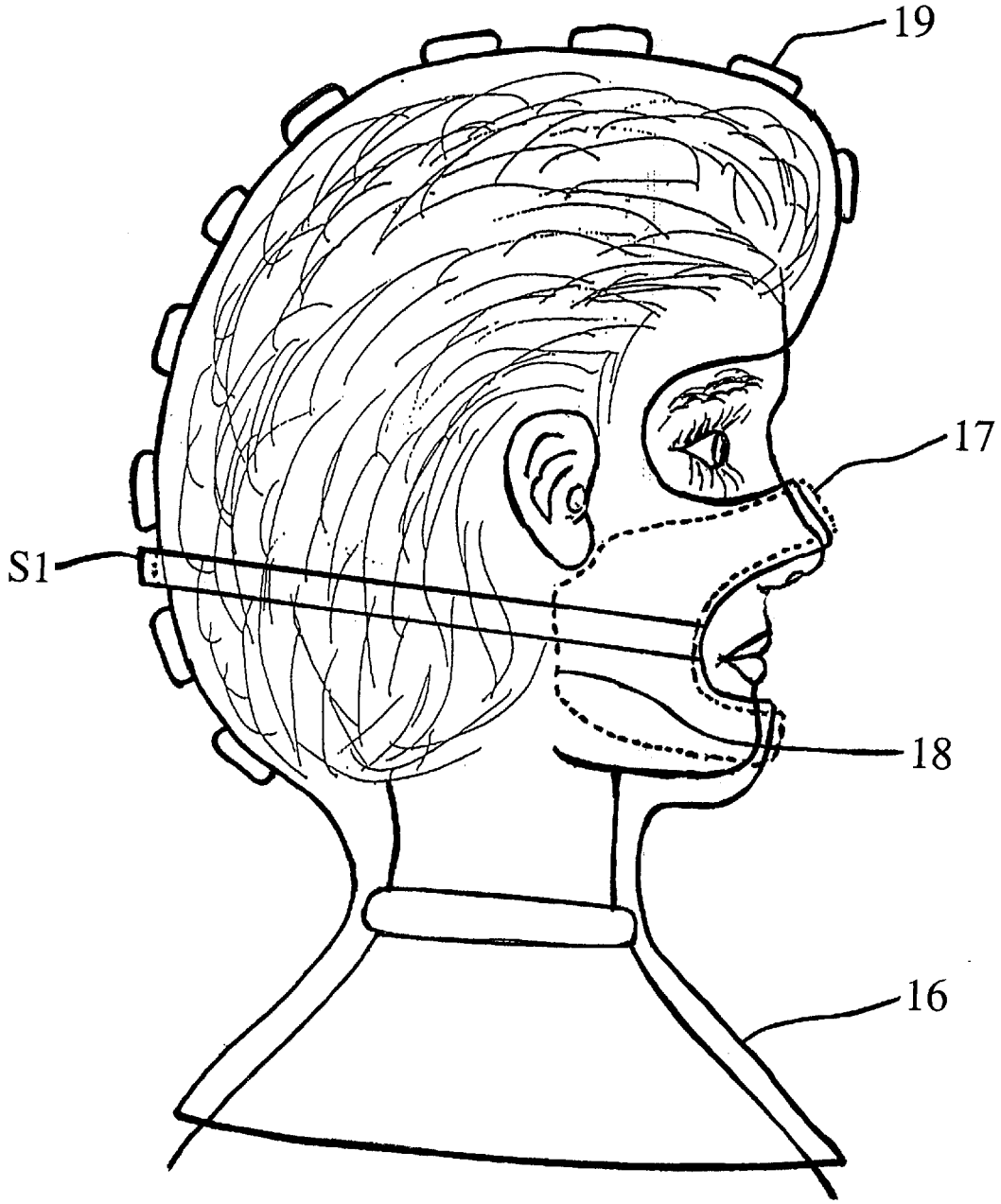
FIG. 2 shows the inner piece of the lining of a super hat.

FIG. 2. This figure shows the lining 16 for the super hat, which will basically be made from a soft, non-irritant fabric in order to keep the area warm, dry and comfortable. This unit will have openings in the eye, nose and mouth areas. In some models it may have openings in the ear area as well. Also, in some models the upper lip area between the nose and mouth may also have a piece to cover that area as well. This unit may be made stretchable in order to allow it to expand and fit the area comfortably or have some areas or components of stretchability. However, importantly, the outer surface of this unit in some areas will have a thin layer of impermeable material such as a layer of plastic which is to prevent moisture from being absorbed by this layer. This may also be made by different methods, such as painting this area with an impermeable paint, etc. This kind of treatment will be more useful in the face area around the nose and mouth as shown with a dotted line 17 and its extension 18. This layer will prevent moisture from being absorbed by the material of this lining. Please notice that such moisture (formed by exhaled air) may not be noticeable in warm weather; however, the experience of this applicant is that when the weather is cold, the vapor from the exhaled air will turn into water or even icy crystals which will give a very uncomfortable feeling to many. This construction will prevent such moisture from being absorbed by the lining, and will allow it to be expelled through the exhaust system. This unit may have a bridge or band of the lining and the related plastic cover in the area between the lower nose and upper lip. This band may be made to be detachable to give the option for the user to use it if so desired.

Importantly, this piece may also have a band made from sponge, balloons or a similar filling piece that will be shaped to go around the nose-mouth area in order to seal the area and prevent moisture from entering the unit. This piece may have a thicker body on the sides of the nose for a better sealing. This piece may be detachable. The lining may be separably mounted to the inner body of the main unit by different means, such as snaps, VELCRO (TM) patches, etc. The combination of the units shown in FIGS. 1 and 2 will have a method of allowing the air to circulate in between them in order to allow the sweat to evaporate and the heat to be released. This includes having windows on the outer unit with a series of covers on them. This may also be done by having an opening for the connection of a tube in order to blow dry and even warm air to the area.

In some models, the outer surface of the inner lining may have raised lines or patches in order to allow a space between the outer layer of this lining and the inner surface of the outer lining to be created. A sample of this (shown at 19) will prevent the outer cover from sticking to the outer surface of the inner liner. A thick screen or skeleton may be placed between the outer and inner layers in order to allow such a space to be made. These screens will be made from plastic, and they will have a body with openings in order to allow the air to circulate between them. Similar to the outer unit, this unit will also have a band or strap in order to pull the front pieces toward the back and hold the front pieces in place securely. In this Figure this is shown at S1 and is an adjustable band that will go around the unit. Importantly, the inner and outer pieces may be connected to each other on a temporary and detachable basis or they may be connected permanently.

Figure 3:
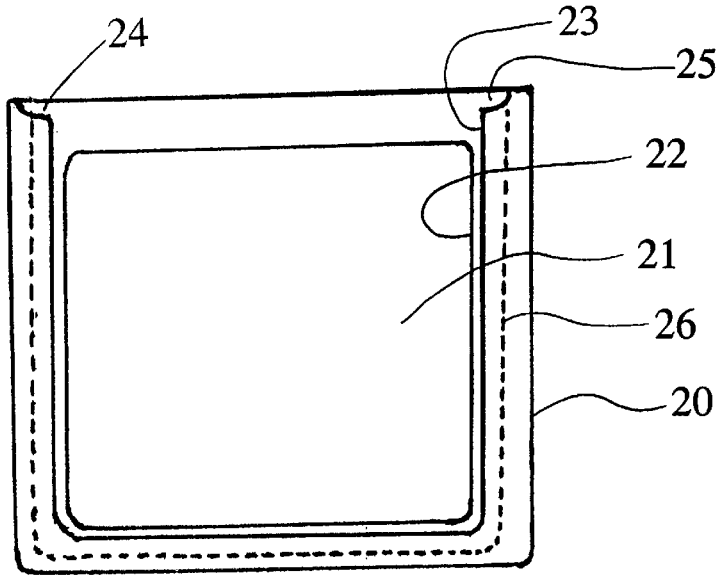
FIG. 3 shows the plastic frame with a slot which is to stand in front of the mouth.

FIG. 3. This figure shows a plastic frame with a slot which is to stand in front of the mouth and allow a desired piece to be inserted into the slot for use. In this Fig. the body of this piece is shown at 20, and it has a wall 23 that creates the slot for the insertion of the other piece. This unit will have an opening in the center which is marked at 21 and will stand in front of the mouth and nose. The border of this opening is shown at 22. Numeral 26 shows the outer border of the slot. Numbers 24 and 25 show the entrance of the slot for the incoming piece. Importantly, this frame may have an opening for the attachment of an oxygen tubing which would allow oxygen users to go outdoors comfortably. Such an opening will allow treated air to be pumped inside the unit as well.

Figure 4:
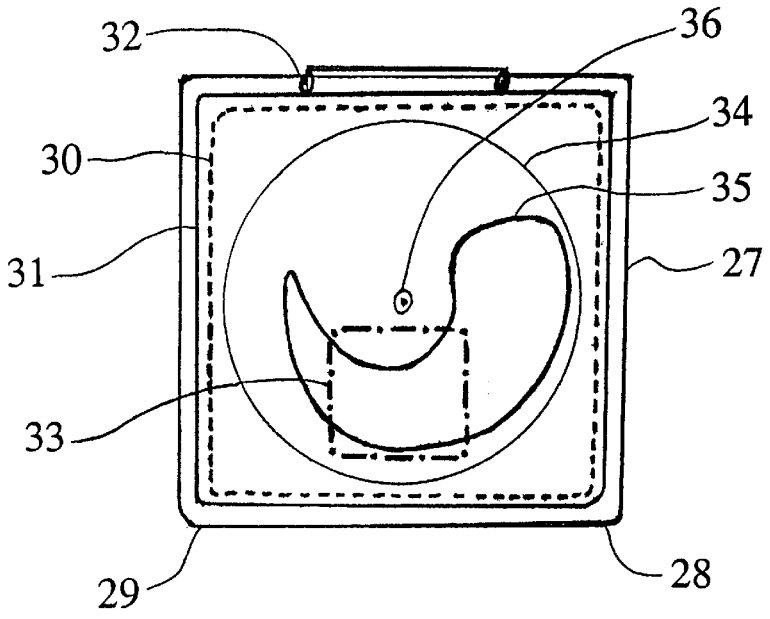
FIG. 4 shows a window unit that is to allow the nature and amount of the incoming air to be controlled.

FIG. 4. This figure shows a window unit that is to allow the nature and amount of the incoming air to the mouth area to be controlled. This will be made from a plastic frame shown at 27 which is properly-sized to fit into the slot of the unit shown in FIG. 3.

This will be done by holding spots 29 and 28 in front of spots 24 and 25 of the unit shown in FIG. 3 and pushing the unit inside the slot (shown in FIG. 3) which will close opening 21. Frame 27 has an opening whose inside border is marked with a dotted line 30. This opening will be closed by door 31 which is hinged to frame 27 at point 32. Door 31 has an opening marked with a dot-dash line 33. This opening will allow air to pass into the mouth and nose area. Door 31 has a circular piece 34 in its front which will rotate around pole 36.

Piece 34 has an opening 35 that, with rotation, will allow the amount of incoming air to the nose and mouth area to be controlled or closed. Importantly, door 31 can be opened to allow the whole opening 30 to be open for different reasons such as eating or drinking, etc. Please notice that hinge 32 may be placed in another site.

Figure 5:
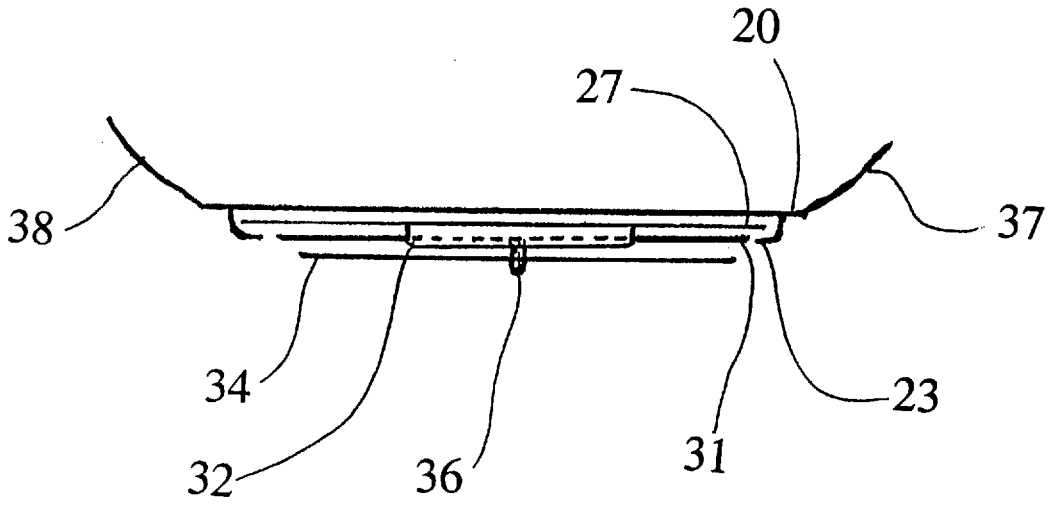
FIG. 5 shows the cross-cut view of the window unit which is placed inside the body of the frame shown in FIG. 3.

FIG. 5. This figure shows the cross-cut view of the window unit shown at FIG. 4 when it is placed inside the body of the frame, shown in FIG. 3. In this Fig. the base of the frame is marked at 20 and is mounted to the cover of the main unit marked at the right by 37 and at the left by 38. Frame 20 has a short wall 23 which makes a slot, and this slot accepts and holds the window unit. The frame of the window unit is marked at 27 and holds door 31 by hinge 32. The door can open and close due to the functioning of this hinge. Door 31 has the rotary, circular piece 34 mounted to its center by pole 36 so that this circular piece can rotate around this pole. The rotation of this piece 34 will allow the amount of the incoming air into the mouth to be controlled.

FIG. 6. This figure shows the cross-cut view of a unit similar to the one shown in FIG. 5, except this Fig. also has an extra slot 39 which allows a filter 40 to be inserted inside the slot in order to allow the nature of the incoming air to be changed.

FIG. 7. This figure is similar to FIG. 1 and schematically shows some of the options and important points of these units, which are hard to point out in FIG. 1. FIG. 7 shows the brim 46 which has clear side walls that are to prevent rain, snow or unwanted particles from coming towards the eye side and obliterating vision. Shield 48 is a fixed unit and extends to attach to the body of the unit in the nose area at 51. The rear end of this shield 49 will extend to the sides and attach to the body of the unit. The round piece 50 has open areas and can be rotated in order to close the openings or leave them open. The pad of sponge shown at 52 extends to circle around the nose-mouth area in order to seal this area effectively. The piece 53 is a small piece that will allow tubing to be attached to it. Numeral 54 shows a microphone. Numeral 55 is an ear cover and will be attached to another piece 56 by the pole 57 so that the outer piece 54 can rotate around a pole 57 and go over the inner piece 56, which is connected to the body of the unit in the ear area. Piece 55 has an opening 58, and piece 56 has an opening 59. The rotation of the piece 55 will put these two openings in front of each other in order to allow direct voice transpassing to occur. Further rotation of the unit 55 will close the opening 59 and prevent air or noise from going inside. Importantly, the body of the cover may be made to have a hole in it and the second rotating piece to be connected to it and to be moved around a central connecting snap. Numeral 60 shows a small speaker which will allow an effective transmission of noise to occur by the use of special instruments. Numeral 61 shows the frame or skeleton that is to hold the front of the unit away from the body in this area. Numeral 62 shows an adjustable piece similar to the piece shown in the nose-mouth area or for the ear. This piece consists of two pieces of round plastic with openings. These pieces will be connected to each other by a pole in their center so that the outer plastic can be rotated in order to allow the openings to match each other or to oppose each other. This will allow the amount of incoming air to be controlled by this method. The edge of the outer plastic may be curved to cover the inner unit in order to prevent snow from entering it. Numeral 63 is to symbolically show a light that may be attached to this unit for use. The body of this cover will have snaps to hold the wires or the oxygen tubing, etc. Number 64 shows the band which isolates the nose-mouth area and prevents air and steam from moving into the rest of this unit.

Importantly, the unit may have a padding inside in different areas to comfortably hold this unit in place. For example, the base of the brim may have such padding.

FIG. 8. This figure shows the front view of the unit shown in FIG. 7 and is chosen to show the side walls of the brim. In this view the brim is shown at 46 and its wall in the right is at 47.

Figure 9:
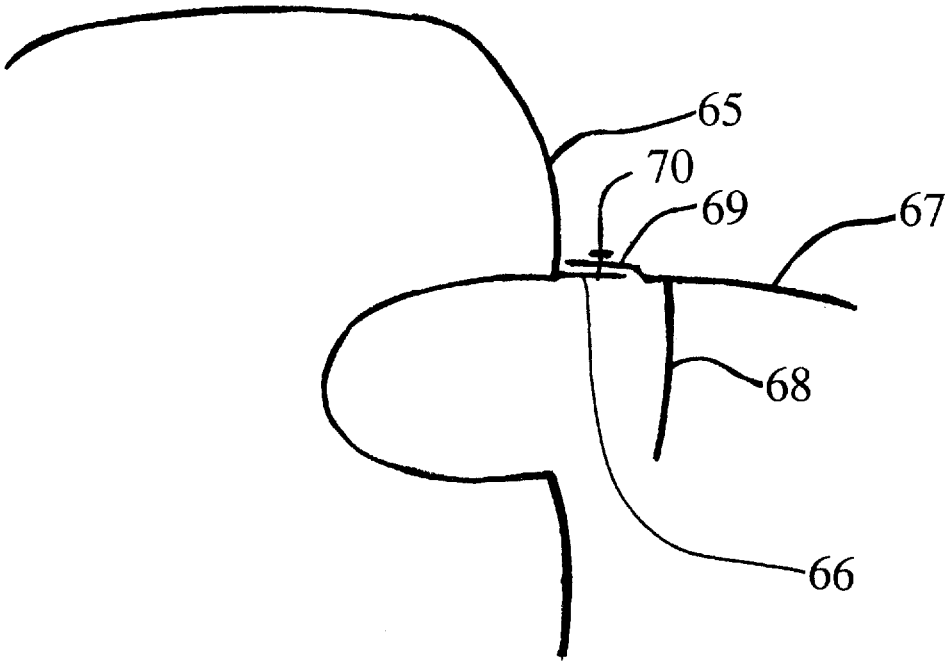
FIG. 9 is a partial side view of a portion of another headwear.

FIG. 9. This figure is similar to FIG. 1. It schematically shows the side view of an outer cover of a super hat. This Fig. is to show how the brim may be made to be detachable and how different brims may be used. In this view the body of the cover is shown at 65 and it has a short brim 66. The second brim 67 has a base 69 which matches the shape of the brim 66 and is secured to it by connection means 70. Brim 67 has shield 68 for protection of the eyes.

FIG. 10. This figure is to schematically show some more details about the piece that is to allow ventilation in these units to occur. This is to show the details of piece B shown in FIG. 1. In this model the fenestrated area 72 of the body 71 of the outer cover has a pole 73 in its center which holds the screw 74 from the center of the round piece B. Screw 74 can rotate inside pole 73. This mechanism will allow piece B to rotate along screw 74 in one direction, to close the opening of this unit, or it to be rotated in the other direction to open the ventilation area. The sides 75 of this opening are curved outward to prevent water from entering the unit.

DETAILED EXPLANATION OF THIS INVENTION

Cold weather is disliked by almost everyone, and cold wind is even worse. The combination of cold, wet, and windy weather is the worst and in practice paralyzes many functions of human beings and prevents normal activity. This kind of weather can cause medical problems ranging from frostbite to heart attacks. The combination of cold and wind is a well known cause of angina pectoris or chest pain from the heart. This happens in patients who have underlying coronary artery disease. Patients who suffer from lung disease or sinus problems also do not do well in cold, wet, or windy weather. Many times such people limit their activities in these conditions, and this applicant believes that they will do well if they take time to prepare for such weather. In fact even many ordinary people would do better if they could avoid exposure to such a combination. However, a unit that will do this job easily is not available and so this applicant wishes to introduce his version of such a unit. In fact, he has introduced parts of these units in his previous applications, mentioned earlier. Basically, these units will be made from combinations of two layers of material:

A. a lining which will basically be made from a soft, non-irritant fabric in the shape of a head and neck cover as shown at 16, FIG. 2. This is to keep the area warm, dry, and comfortable. This unit will have openings in the eyes, nose and mouth areas in order to allow vision, breathing and communication to be possible. Importantly, the outer lining of this unit in some areas will be covered by a thin layer of impermeable material such as a layer of plastic or similar material (which may be sprayed or painted on this area). This layer is to prevent outer moisture from moving inside and moistening this lining. Even though the layer may cover different areas, it will specially be placed on the face area around the nose and mouth as shown with a dotted line 17 and its extension 18. This layer will then prevent the moisture from being absorbed by the material of this lining in this area, which becomes moist due to exhaled air. This moisture may not be noticeable in warm weather; however, the experience of this applicant is that in cold weather, vapor from exhaled air will turn to water or even ice crystals which causes a very uncomfortable feeling for many. However, this construction will prevent such moisture from being absorbed by the lining and causes the moist air to be expelled through the exhaust system. This exhaust system may also have a flap, cover, or door in order to allow air motion through the exhaust system to be controlled. This may consist of two pieces of round plastic with openings that will be connected to each other with a pole in their center so that the outer plastic can be rotated in order to allow the openings to match each other or oppose each other. This will allow the amount of air to be adjusted or even closed. A sample of this unit is shown for the ear FIG. 7. Importantly, the units, whose front openings have a filter and an adjustable door, may or may not have the exhaust system.

This unit may have a bridge or band of lining and impermeable cover in the area between the lower nose and the upper lip as well. This band may be made to be detachable. This lining may be separably mounted to the inner body of the main unit, which may be done by different methods such as the use of snaps, VELCRO (TM) patches, etc.

B. The unit will also have a water and air-impermeable layer which will be shaped to fit the head of the person. This unit may be made to cover the lower face and even the neck and upper chest area as well for full protection. This unit may have a brim that will prevent rain, snow or wind from coming toward the eyes. Importantly, this brim may be made to bend or roll backward or forward. This can be done by having bands or hinges on the sides. In some models this brim may be made detachable as well so that the user will have the option of using it if desired. This brim may be made clear; however it may have a matching colored piece which will be attached to it in order to make it non-opaque. Also, this brim will have a clear shield 13 which will be hinged to the piece 3 at 15. The shield 13 may also be made to be a fixed part of the body of the brim so that all will be one piece. This shield will have wings on the sides (one of these is shown at 14) which will prevent wind or cold air from disturbing the person from the sides. Also, the wings will prevent the edges of the shield 13 from moving toward the eyes and causing problems. Importantly, the lower border of the shield may be connected to the body of the unit in order to prevent air from moving inside. The sides of this piece may have openings to allow steam formed in the eye area due to sweat or evaporation of tears to be blown away. These openings may have covers to allow them to be adjustable.

This unit will have a system to prevent the fabric from standing close to the mouth and nose and causing a feeling of suffocation. This may be done by making this area rigid or it will be made from a skeleton that will prevent the body of the cover from standing close to the face and mouth. Importantly, this skeleton will have the means and functional capacity to prevent the layer of the unit from standing close to the mouth and nose and causing a sense of suffocation. The area between the nose and mouth may be further separated from the eye area by the adjustable band 7 in order to prevent fogging. The piece 7 may be made from a pad of sponge, a piece of balloon, or mosaics of small bubbles properly shaped to stand in this area and prevent air movement between these two areas. Pieces of metal wires or bands may also be placed in the area to allow this unit to have an adjustable mechanism to accept and hold the wanted shape. This piece may be conformed by the user to fit his or her face shape. The space in the mouth and nose area will be connected to one or more exhaust systems (marked at 9) which may be placed in a proper area, such as the sides of the face, in order to allow the exhaled air to be expelled out of the unit without moving to other areas. This is to prevent moisture or cold weather from transpassing. The exhaust system may have an adjustable opening or door similar to the one shown at Numeral 62, FIG. 7. Importantly, this unit may also have an adjustable opening in front of the mouth in order to allow the amount of air, and at times its direction, to be controlled. This system is shown at FIG. 1 at 10–12 and will be achieved by the e use of a unit made from a piece 10 (that is attached to the body of the unit in the nose-mouth area) and a slot whose border is marked at 11. This u nit will allow a matching piece 12 to be inserted into it. Piece 12 will allow the nature and amount of the incoming air to be altered favorably. The details of this unit are discussed in FIG. 3 and 4. Piece 12 will have adjustable openings. This will give an advantage in windy and cold conditions. This unit will also allow a filter to be placed in this area so that the air can be affected by that filter. Such a filter may be placed inside the cover or it can also be attached outside of this unit. Importantly, the nature of this filter may vary depending on the environment of the area in which it is used.

Importantly, the mechanism for the unit 10–12 will allow different kinds of pieces to be inserted into this slot and be used for different purposes. This unit will also allow a cover to be hinged to the body of the unit so that it will allow the unit to be opened and closed easily in order to allow easy access to the mouth and nose area for cleaning, drinking, eating, communication, etc. This will be easily done by having a frame on the base of this unit and units 10–12 to be hinged on it. A snap will allow it to be kept in the closed position.

Importantly, this unit gives the means of controlling the amount a and nature of the incoming air. This will be done by the method which is shown at FIGS. 3 and 4. Basically, this will be done by having a plastic frame 20 with a slot in front of this unit in the mouth area. This slot will allow an exchangeable piece such as the one shown in Fig 4 to be inserted into slot 25. The body of such a slot is shown at 20 and has a wall 23 that creates slot 25 for the insertion of the other piece. Frame 20 has opening 21 in the center which will s stand in front of the mouth and nose. The border of this opening is shown at 22. Numeral 26 shows the outer border of the slot. Numbers 24 and 25 show the entrance of the slot for the incoming piece. FIG. 4 shows the unit that is to allow the nature and amount of the incoming air to the mouth area to be controlled. This piece is made from a plastic frame shown at 27 which has a matching size to slide into slot 25 of the unit shown in FIG. 3. This will be done by holding spots 29 and 28 in front of spots 24 and 25 of the unit shown in FIG. 3 and pushing this unit into the slot 25. Frame 27 has the opening 30 inside whose border is marked with the dotted line at 30. This opening will be closed by the door 31 which is hinged to frame 27 at 32. Door 31 has an opening marked with a dot-dash line at 33. This opening will allow the air to pass into the mouth and nose area. The door 31 has a circular piece 34 attached on its front. Piece 34 will rotate around the pole 36. Piece 34 has an opening 35 that, with rotation, will allow the amount of the incoming air into the nose and mouth area to be controlled or even totally blocked. Importantly, the door 31 can be opened to allow the whole opening 30 to be available for different uses such as drinking, eating, etc. Hinge 32 may be placed in another site.

Importantly, the brim of this unit may be made from a clear plastic piece, and it may also have wing side walls that will bend to the sides in order to prevent the wind from coming into the area. Also, this unit may have a clear rigid piece shown at 13 which will be hinged to piece 3 at 15. Shield 13 may have side pieces or wings 14 placed on the sides in order to prevent the wind or cold air from disturbing the person from the sides. Also, importantly these wings are to extend to the sides of the face in order to prevent shield 13 from hitting the eye and causing problems, since they will direct the wings to the sides of the face and not to the eye area. The base of this shield will stand close to the base of the nose in order to prevent it from getting too close to the eye and causing damage. These pieces may be made from soft materials or materials that will not break easily. Importantly, the brim may be made from different material, thickness, consistency, etc. It may be made clear but can have a matching colored piece which can be removably attached to it in order to make it non-opaque. Also, this brim will have a clear shield 13 which will be hinged to piece 3 at 15. Importantly, shield 13 may be made to be a fixed part of the body of the brim so that all will be one piece. This shield will have wings on the sides like the one shown at 14 which will prevent wind or cold air from disturbing the person from the sides. Also, the wings will prevent the edges of shield 13 from moving toward the eye and causing problems. Importantly, the lower border of the shield may be connected to the body of the unit in order to prevent air from moving inside. The sides of this piece may have openings to allow steam from the eye area, due to sweat or the evaporation of tears, to be blown away. These openings m ay have covers to allow them to be adjusted.

Importantly, the sealing band of these units which is shown at 7 may be made to go further around the sides for more protection, or another piece may be placed in the chin area to protect the neck area. It may also be made to encircle the nose and mouth area in order to completely seal this area and prevent moist air from entering the unwanted areas.

Importantly, this unit may be made with an ear cover which may have a window to allow it to be opened. This window may be directional in order to allow noise to be gathered from a particular site. The connection area between the head and the neck piece may have an elastic ribbon 4 that can be adjusted by the piece 5 to prevent air from moving to the neck areas. This will also help this unit to stand in the area securely and comfortably.

This unit will have a means to prevent exhaled steam from moving toward the eyes and causing fog to form on the glasses. For this purpose the unit will have a band, rim, piece of sponge, padding, or an inflatable balloon that will be properly shaped in order to fit the base of the nose and extend to the sides in order to prevent the exhaled air from reaching the eye and/or unwanted areas. This piece will be made to be adjustable so that it can be fitted to each individual. This may be done by the use of metal, plastic or aluminium wires, bands, or pieces that will allow the shape and body of these sponge pieces to be adjusted. This sponge or blocking piece may be covered by a soft, comfortable fabric or cover that will have a pleasing touch. In some models, a heating element or means may even be included in this area to allow the person to enjoy heat in cold weather.

Importantly, this unit may also be made to have a means of communication, such as microphones and speakers, to be connected to it in order to allow easy communication to occur in cases in which the outside noise, environment, or distance does not allow comfortable communication. This may be extremely important in conditions such as army units, teams working in cold, windy, or snowy weather or similar conditions. In these conditions the earphones will be placed in the ear area and the speakers are to be attached to the mouth area. The body of the communication unit can be like a "Walkie-Talkie" or CB unit and will be connected to the belt of the person or placed in the pocket of the user. The wires will be secured by a series of holding means in the sides of the unit. This method will be of significant importance in many jobs. The outer unit may also have a means of holding the oxygen tubing or other tubing on its body safely.

Importantly, this unit may have a light bulb and reflecting mirror like a flashlight connected to its brim in order to allow the light to be used without the need to hold it. The battery pack of such a light will also be held in the belt area or pocket, and the wire is to be held in the sides of the unit by snaps.

Importantly, the incoming air may be treated by various means in order to have its temperature, moisture and other components treated in the desired and needed way. This will allow people to work safely in difficult circumstances, such as in polluted air or extreme cold, etc. This can be an oxygen tank or a unit that will treat the air and make it more beneficial. This unit will have a fan to force air into the hat so that the person would not need to use energy to suction the air. The main unit may be placed at a distance and the air can come into the hat by a small tube to add versatility so that the person wouldn't have to carry the unit. The fact that the exhaust system will deliver the air backwards or to the side may help prevent fogging of certain things, such as car or truck windows. The opening of the exhaust system may also have a tubing to allow the exhaled air to be moved even further away.

This unit may also have openings in its body in order to allow the ventilation under the outer unit to occur in order to have the extra heat and sweat escape. These openings may have covers in order to close them when needed. One such opening is shown at A in FIG. 1. In this simple model, the fenestrated area 41 is covered by the cover A which will be closed by means 42. This cover may be opened and kept open by having it attach to the outer surface of the unit. Another model of such a ventilation unit is shown at B in the same Fig. In this model the fenestrated area 44 has a screw pole 43 in its center which is holding the piece B on it s end. Piece B may be made to rotate in one direction along the screw 43 in order to close the opening or be rotated in the other direction in order to open the ventilation area. The sides 45 of this opening will be curved on the outside to prevent water from moving into the unit. Many of the above-mentioned methods may be used i n order to make such a ventilation opening.

The uses of these units are many and the applicant believes that this unit will allow many jobs to be done easily in difficult conditions. The unit may be used in the army, on ships, or in severe conditions such as in the Arctic region, etc. This unit will importantly protect the nose, mouth and respiratory systems and may prevent many cases of sinusitis, bronchitis, angina pain and suffering in the susceptible cases. Thus, it is made with the intention to prevent human suffering. It should be kept in mind that many times the prevention of a problem is far easier and more economical than the cure. For example, if this unit is used properly and prevents one case of bronchitis and sinusitis, it will easily pay for its expense. Or if a person could use these hats to continue his/her walks to promote his/her health, then it will prevent many problems which come with the lack of activity.

Importantly, these units may use one-way valves in the front as well as in the exhaust system to direct the air in only one direction. This will prevent the air from going into the tubing or the filter area and will also prevent the air from entering through the exhaust system.

The units that are to treat air were explained in the Super Masks application, mentioned earlier. Basically, these units will consist of a body with filters that will purify the air and have a source of heat to warm it. The air may also be altered by adding humidity, or taking extra moisture away from it in order to make it better. Ionizers may be added in some cases as well. Perfume or medications, such as Broncho-dilators, may be added to these units. The air from such a source will be carried inside the super hat by a canula and will allow the person to enjoy it. A fan will help move the air. A suction fan may also be used to suction the air from the exhaust system.

Importantly, the technique used in this application may also be used in making the face masks as well. For example, the use of removable front doors with spaces for the filter will be a very comfortable means of controlling the incoming air in units that were introduced in the application for Super Masks, mentioned earlier. Therefore, the applicant indicates such models and introduces that it will be easy to design such face masks with these teachings.

Importantly, many parts of these units will be made to be exchangeable in order to allow a different or new part to be used. The pieces that seal the area may also be changed. The unit will be made to be colorful, likeable, and light-weight. The shields may be made from soft flexible materials. All of these will allow the manufacture of an adjustable unit that will be a very useful piece.

Importantly, the size, shape, thickness, consistency, relative sizes and thicknesses, coloring and every other important factor and characteristic of these units may vary in order to allow different units to be made for different purposes.

I claim:

1. A flexible hood assembly for a wearer's head comprising:

an inner hood lining made of flexible material that serves to keep a wearer's head warm in cold weather; said inner hood lining adapted to fit over and against the top, sides, back and the face of a wearer's head, including openings for eyes, nasal passages, and mouth; said inner hood lining comprising an impermeable area for encircling a wearer's nasal passages and mouth and comprising a nose-spanning portion for extending across the bridge of a wearer's nose and a chin-spanning portion for extending across a wearer's chin, and means for causing said impermeable area to be held against a wearer's face in encircling relation to a wearer's nasal passages and mouth;

an outer hood layer made of flexible material that is air and water impermeable and adapted to fit over said inner hood lining, said outer hood layer including at least an opening for a wearer's eyes;

a skeleton structure adapted to be disposed in covering relation to a wearer's nasal passages and mouth to space said outer hood layer from a wearer's nasal passages and mouth, and means for causing said skeleton structure to be held against a wearer's face in covering relation to a wearer's nasal passages and mouth;

means for spacing said inner hood lining from said outer hood layer and for forming an air gap;

means for selectively venting excess hot air accumulated in said air gap;

transparent eye cover structure adapted to be disposed in covering relation to a wearer's eyes;

means for preventing fogging of said transparent eye cover structure comprising a band for extending across the bridge of a wearer's nose between said inner lining and said outer layer to separate openings in the inner lining such that moisture from the nasal passages and mouth is blocked from reaching the transparent eye cover structure; and an exhaust system that carries exhaled air out of said hood assembly.

2. A flexible hood assembly as set forth in claim 1 in which said means for selectively venting excess hot air accumulated in said air gap comprises one or more discrete openings that can be opened and closed.

3. A flexible hood assembly as set forth in claim 2 in which one of said openings that can be opened and closed is disposed over the ear.

4. A flexible hood assembly as set forth in claim 1 in which said means for spacing said outer inner hood lining from said outer hood layer and for forming an air gap comprises a number of protrusions on the exterior of said inner headcover.

5. A flexible hood assembly as set forth in claim 1 in which said transparent eye cover structure comprises an eyeshield provided on said outer headcover to selectively open and totally close an eye opening therein, and said eyeshield includes areas at its sides that can be selectively opened and closed to allow air to pass through said eyeshield when totally closing said eye opening.

6. A flexible hood assembly as set forth in claim 5 including a brim extending forwardly from said outer hood layer over the eyes.

7. A flexible hood assembly as set forth in claim 1 including a brim extending forwardly from said outer hood layer over the eye opening and said transparent eye cover structure extending downward from said brim to at least below eye level.

8. A flexible hood assembly as set forth in claim 1 in which said outer hood layer comprises an opening for the nose-mouth area, and mounting means mounting one or more members to cover said opening for the nose-mouth area.

9. A flexible hood assembly as set forth in claim 8 in which a filter member is removably associated with the exhaust system to prevent unwanted particulate material from entering the nose and mouth.

10. A flexible hood assembly as set forth in claim 8 in which an adjustable aperture is associated with the exhaust system to allow the person to set a desired amount of opening for the nose and mouth area.

11. A flexible hood assembly as set forth in claim 1 in which an audio communication system is provided in association with said hood assembly.

12. A flexible hood assembly as set forth in claim 1 in which an eye brim is removably mounted on said outer hood layer adapted to project away from a wearer's forehead.

13. A flexible hood assembly as set forth in claim 1 in which said transparent eye cover structure comprises an eyeshield pivotally mounted on said outer hood layer to project away from the forehead, and to be pivoted to cover and uncover the eye openings.

14. A flexible hood assembly as set forth in claim 1 in which a connection is provided to allow treated air or oxygen to be delivered through said outer hood layer for breathing.

* * * * *